US007043777B2

(12) United States Patent
Bloom et al.

(10) Patent No.: US 7,043,777 B2
(45) Date of Patent: May 16, 2006

(54) SINGLE CONTROL FAUCET INSTALLATION APPARATUS AND METHOD

(75) Inventors: Mark S. Bloom, Mission Viejo, CA (US); Alston E. Williams, Irvine, CA (US); Li Chen, Brea, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/433,283

(22) PCT Filed: Sep. 27, 2002

(86) PCT No.: PCT/US02/30878

§ 371 (c)(1),
(2), (4) Date: Nov. 3, 2003

(87) PCT Pub. No.: WO03/029570

PCT Pub. Date: Apr. 10, 2003

(65) Prior Publication Data

US 2004/0078893 A1 Apr. 29, 2004

Related U.S. Application Data

(60) Provisional application No. 60/326,651, filed on Oct. 3, 2001.

(51) Int. Cl.
*E03C 1/042* (2006.01)

(52) U.S. Cl. ..... 4/695; 249/177; 285/124.2; 285/139.1

(58) Field of Classification Search ..... 4/675–678, 4/695; 52/220.8; 249/53 R, 53 M, 177; 285/124.2, 139.1, 142.1, 205
See application file for complete search history.

(56) References Cited

U.S. PATENT DOCUMENTS 1,651,269 A * 11/1927 Gnagi ..... 249/177 X
3,035,276 A * 5/1962 Hanson ..... 4/695
4,834,825 A * 5/1989 Adams et al. ..... 285/124.2 X
5,967,567 A * 10/1999 Nordstrom ..... 285/139.1

* cited by examiner

*Primary Examiner*—Robert M. Fetsuga
(74) *Attorney, Agent, or Firm*—Richard J. Veltman; John D. Delponti

(57) ABSTRACT

A single control roman tub faucet (8) includes a lower anchor (10) that is attached to the roughed-in tub surround (51) and an upper anchor (18) that is installed on the final decorative surface of the tub surround. The upper anchor is attached to the lower anchor by a fastener (40) that extends therebetween. Outlet pipes (16) extend through the lower and upper anchors and connect water supply lines to the faucet.

10 Claims, 8 Drawing Sheets

SINGLE CONTROL FAUCET INSTALLATION APPARATUS AND METHOD

This application claims the benefit of Provisonal Application No. 60/326,651, filed Oct. 3, 2001.

The present invention relates to single control faucets in general and to roman tub faucets in particular. More particularly, the invention relates to the installation apparatus and methods used for single control roman tub faucets.

BACKGROUND OF THE INVENTION

Roman tub installations are unique for two reasons. The first is that the plumbing must be installed after the roughed-in tub surround is built but before the decorative surface is applied. This is because once the decorative surface is applied and the tub is installed, there is no access to the internal plumbing.

The second unique feature of a roman tub installation is that, because of lack of access after the installation is complete, the roughed-in plumbing must account for a range of thicknesses of the decorative surface. Typically, a finisher lays on mud and tile to provide a decorative surface. However, the thickness of the mud and tile varies from site to site and from finisher to finisher. Accordingly, the faucet installer must leave sufficient inlet pipe extending above the rough tub surround to accommodate the thickest layer of mud and tile to be encountered. After the finished surround is completed, the faucet installer must return, cut the excess length from each inlet pipe, and then install the valves and spout. An installation apparatus and method that eliminates the need to cut the rough plumbing to fit the finished faucet placement would be welcome by faucet installers.

SUMMARY OF THE INVENTION

Roman tub installation apparatus includes a first anchor that has inlet and outlet tubes defining water passages and a flange that engages the roughed-in tub installation. A second anchor that engages the decorative surface applied over the roughed-in installation and is coupled to the first anchor by a bolt. A faucet fits over the second anchor and is attached thereto by a set screw.

Other features and advantages will become apparent from the following description when viewed in accordance with the accompanying drawings and appended claims.

BRIEF DESCRIPTION OF THE INVENTION

FIG. 1 is a perspective view of installation apparatus according to the present invention.

FIGS. 2*a*–2*b* are top and bottom perspective views, respectively, of the installation apparatus installed on a rough surface.

FIGS. 3*a*–3*b* are front and rear perspective views, respectively, of the installation apparatus installed on a finished decorative surface.

FIGS. 8*a*–8*d* are views of a rough-in adapter for use with an alternative embodiment of the present invention.

Figure 9A:
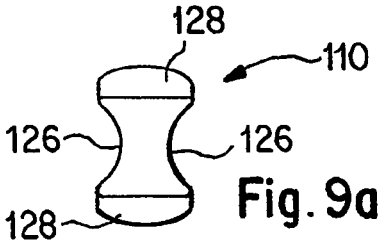
Figure 9C:
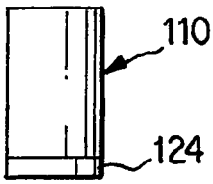
Figure 9B:
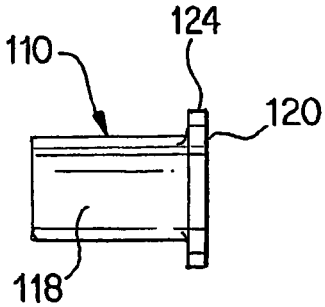

FIGS. 9*a*–9*c* are views of a coupler for use with an alternative embodiment of the invention.

Figure 10:
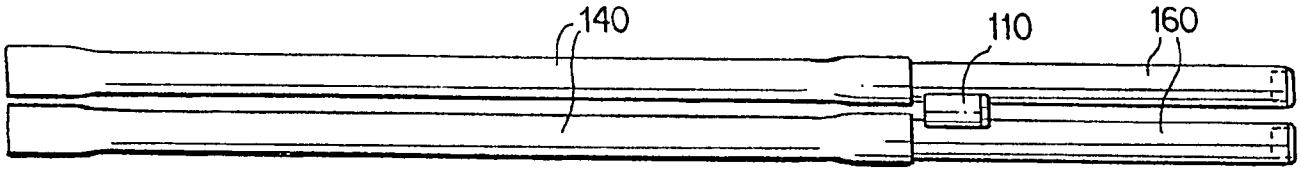

FIG. 10 is a side view of the inlet tubes joined by the coupler of FIG. 9.

FIGS. 11*a*–11*e* are views of a plaster guard.

Figure 12A:
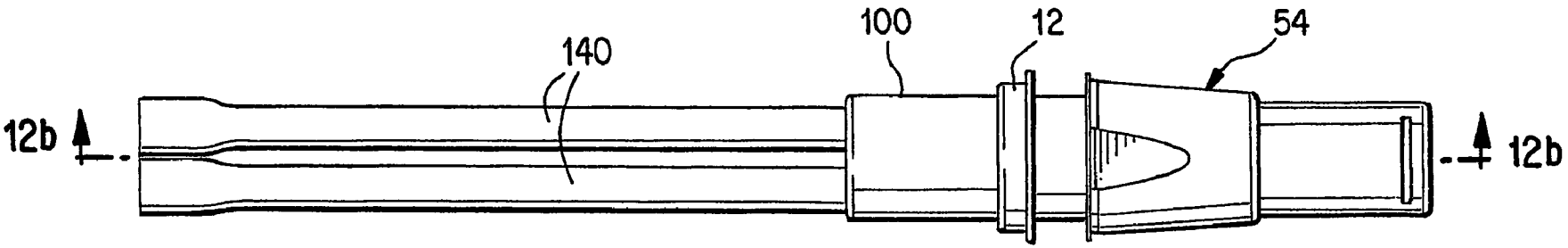
Figure 12B:
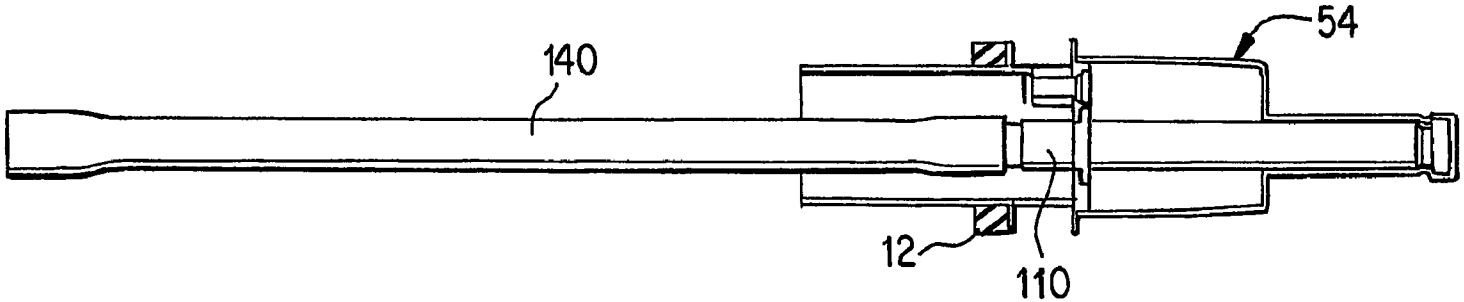

FIGS. 12*a*–12*b* are views of an installation kit.

Figure 13:
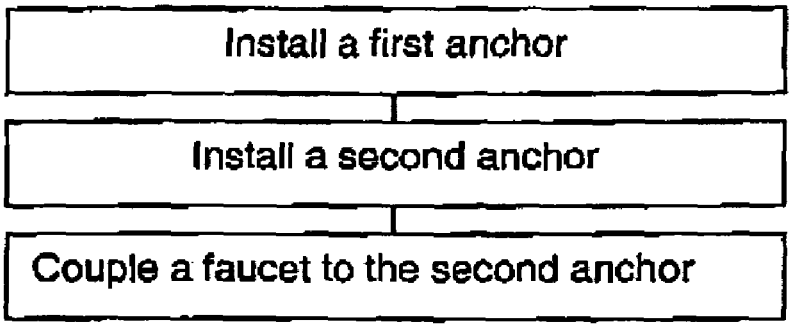

FIG. 13 illustrates a method of installation.

DETAILED DESCRIPTION OF THE DRAWINGS

Apparatus for installing a single control roman tub faucet 8 is illustrated in FIGS. 1–7. The apparatus includes a lower anchor 10, a nut 12, a pair of copper inlet tubes 14, a pair of brass outlet tubes 16 brazed or soldered to the inlet tubes 14, and an upper anchor 18 (FIGS. 3*a*–3*b*). The lower anchor 10 includes a generally cylindrical body 22 having an externally threaded sidewall 24 and an end cap 26. The end cap 26 extends radially outwardly beyond the sidewall 24 to form a flange 28. The end cap further includes a threaded bore 32 extending axially therethrough. The inlet and outlet tubes 14,16 pass through, and are attached to, the end cap 26 to define a pair of water passages therethrough. Preferably, each outlet tube 16 includes a threaded outlet end 30 configured to receive a plug 31 for pressure testing the installation. The inlet tubes 14 preferably include a flared end portion (FIGS. 10, 12) for receiving water supply lines therein.

The second anchor 18 includes a cylindrical body 34 having an upper flange 36 and a lower flange 38 (FIG. 4) that cooperate to define a set screw-retaining groove 42. Preferably, the lower flange 38 extends farther out than the flange 28 of the first anchor 10. A pair of bores 44 extend axially through the body 34 to receive the outlet tubes 16, and a third bore 46 extends axially through the body 34 to receive a fastener 40, typically a bolt. The third bore 46 is positioned on the upper anchor 18 so as to be aligned with the threaded bore 32 in the lower anchor 10 when the outlet tubes 16 are disposed in the bores 44. Thus, the fastener 40 extends through the third bore 46 and screws into the threaded bore 32, thereby locking the upper anchor 18 to the lower anchor 10.

Figure 1:
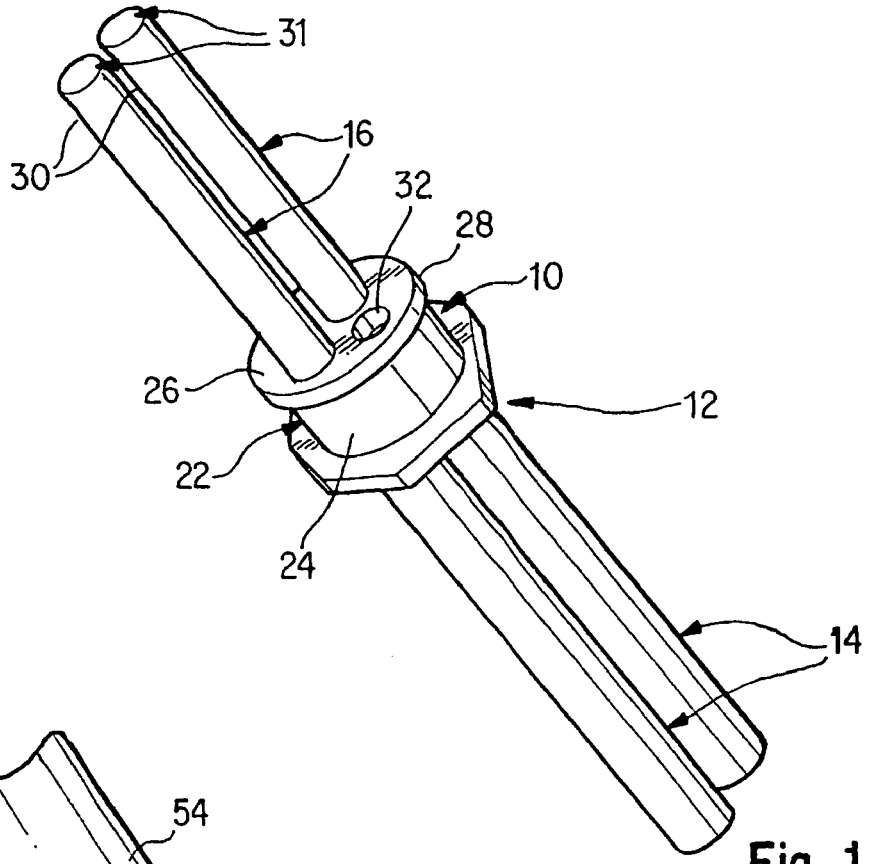
Figure 2A:
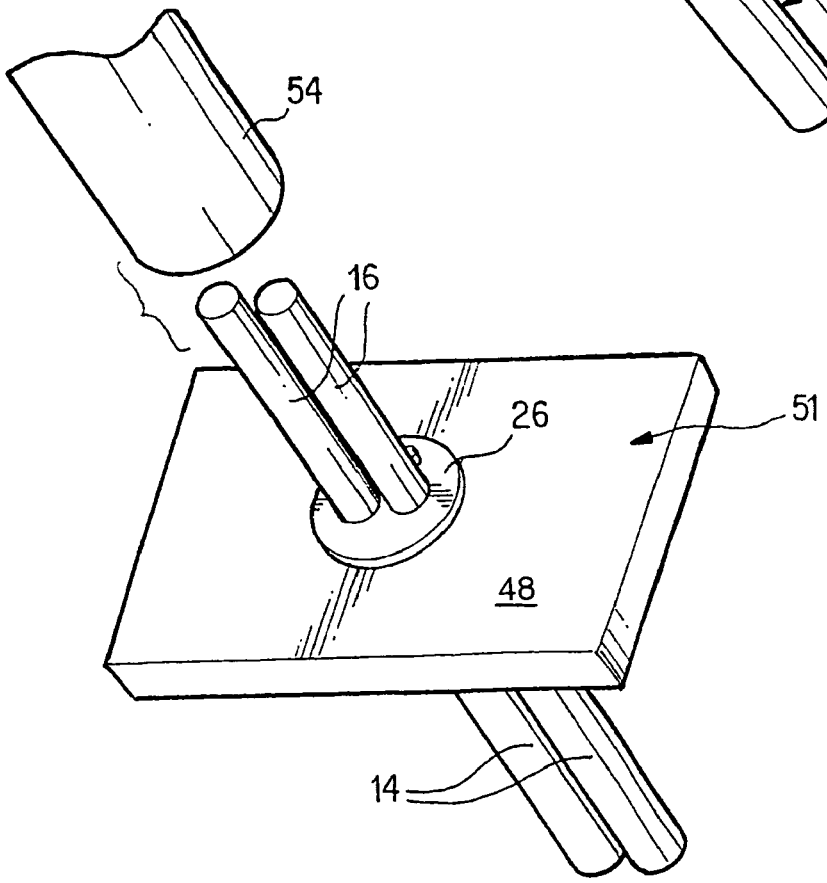
Figure 2B:
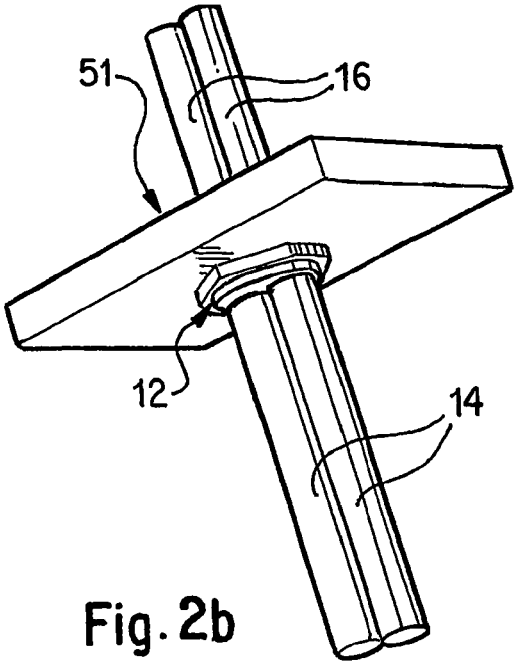
Figure 3A:
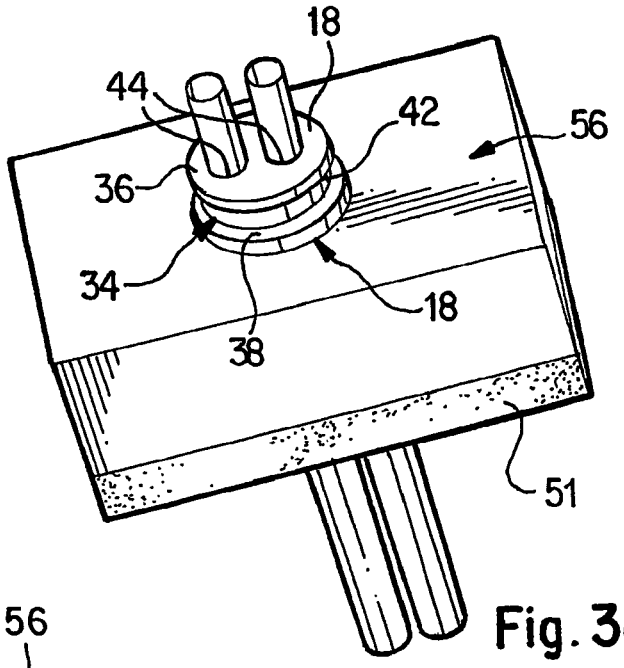
Figure 3B:
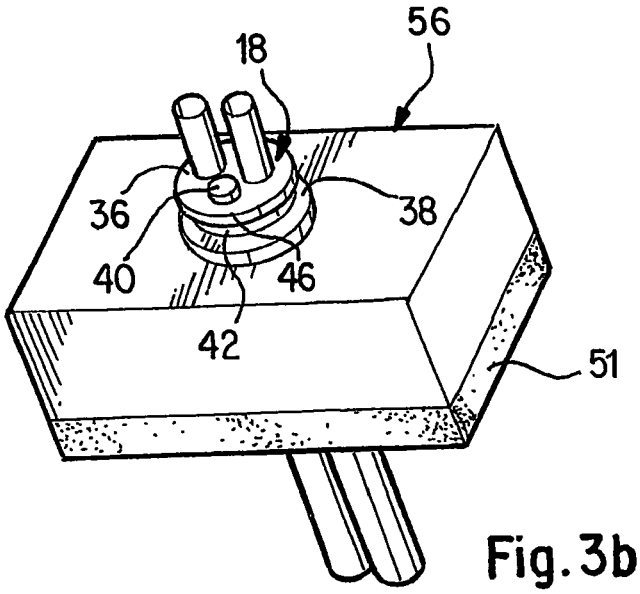
Figure 5:
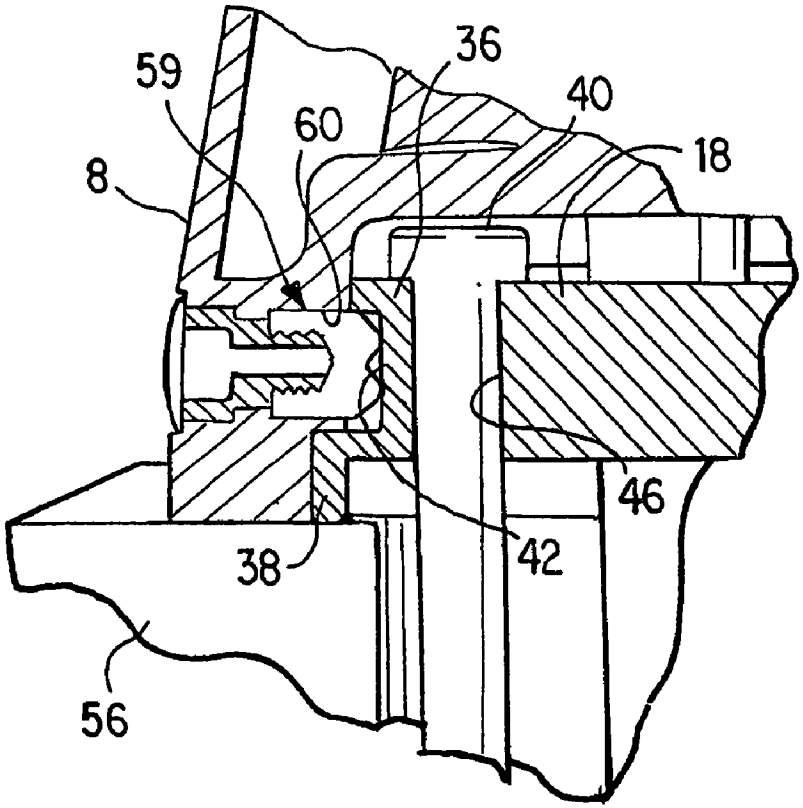
FIG. 5 is a detailed view of a set screw attaching the roman tub faucet to the upper anchor illustrated at 5 in FIG. 4.
Figure 4:
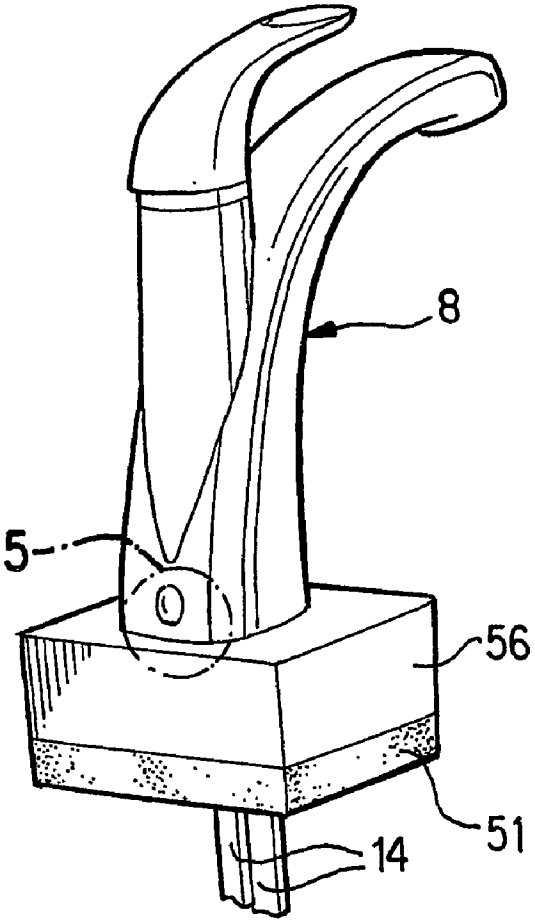
FIG. 4 illustrates a roman tub faucet mounted on a decorative surface and showing the location of a set screw.

As illustrated in FIG. 2, the first anchor 10, with the tubes attached, is inserted through a hole in a roughed-in tub surround 51, which is typically plywood sheeting. The nut 12 is threaded onto the threaded sidewall 24 from below the tub surround 51 to retain the first anchor 10 in position. When installed, the flange 28 of the first anchor 10 engages the top surface 48 of the tub surround 51, while the nut 12 engages the lower surface 50. The installer then connects the inlet tubes 14 to the water supply and pressure tests the installation.

Figure 11C:
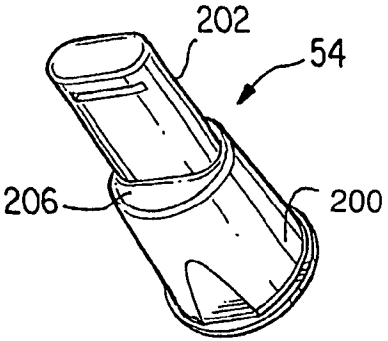
Figure 11B:
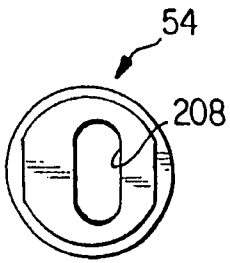
Figure 11E:
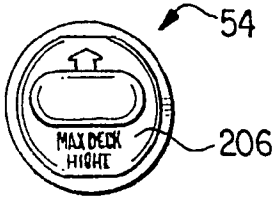
Figure 11A:
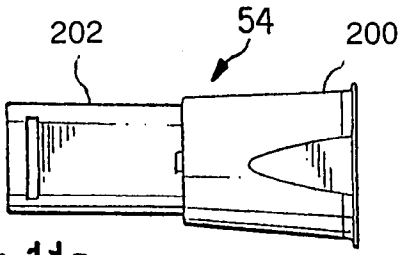
Figure 11D:
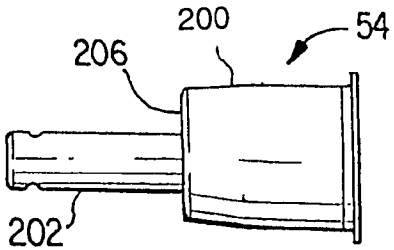

The installer slides a plastic tube 54 (FIGS. 2 and 11) over the first anchor 10 and the outlet tubes 16 to protect them from mud applied for a decorative surface 56 and to provide a uniform opening in the mud for the final installation. The decorative surface 56 typically includes a layer of mud covered with ceramic tile entirely covering the roughed-in tub surround 51. However, while the thickness of the ceramic tile is fairly uniform, the thickness of the mud layer varies with the individual installers and the application. Thus, the length of the plastic tube 54 should be in the range of 3–5 inches. Preferably, the plastic tube 54 provides a visual indication of the maximum height of the mud and tile, as indicated in FIGS. 11*d*–11*e*. Preferably, the decorative surface 56 is laid down right up to, and against, the plastic tube 54.

After the decorative surface 56 and roman tub are installed, the faucet installer removes the plastic tube 54. The second anchor 18 is installed by sliding it over the outlet tubes 16, with the outlet tubes 16 passing through the pair of bores 44, inserting the fastener 40 into the third bore 46 and screwing the fastener 40 into the threaded bore 32 in the first anchor 10. The larger lower flange 38 of the upper anchor 18 extends beyond the opening in the decorative surface 56 and engages the top surface thereof. The flange 38 cooperates with the first anchor 10 to provide a rigid supporting base for the faucet 8.

Figure 7:
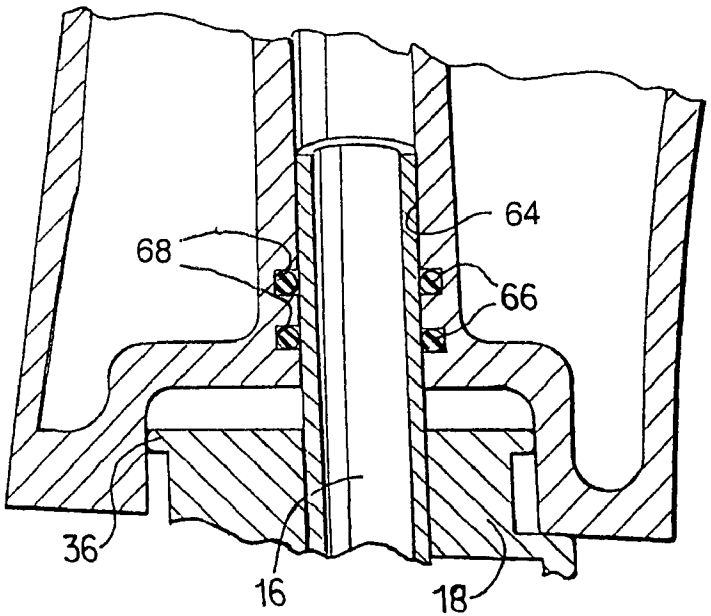
FIG. 7 is a detailed view of the o-ring installation for sealing the outlet tubes in the faucet illustrated at 7 FIG. 6.
Figure 6:
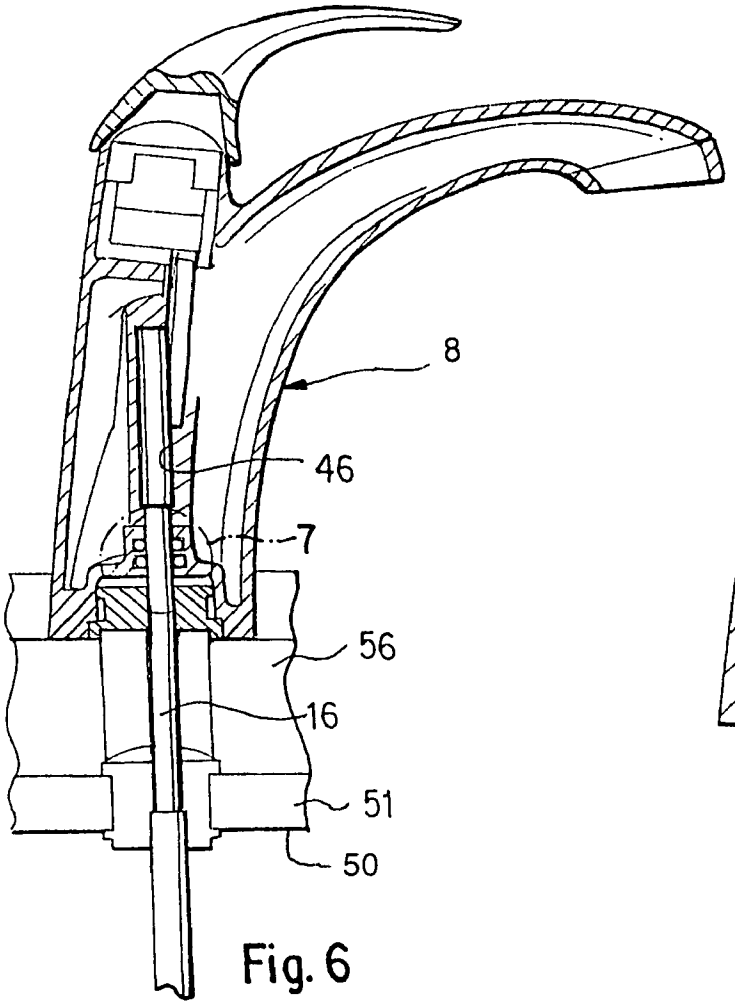
FIG. 6 is a section view through the installation apparatus and faucet illustrating the final installation.
Figure 8A:
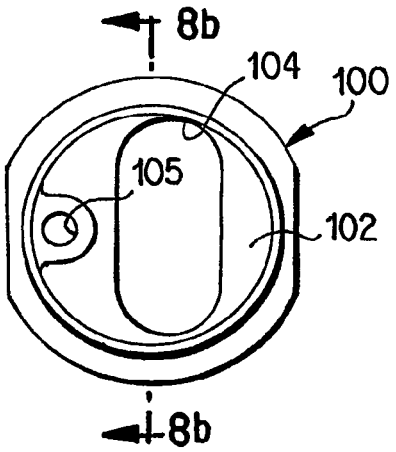
Figure 8B:
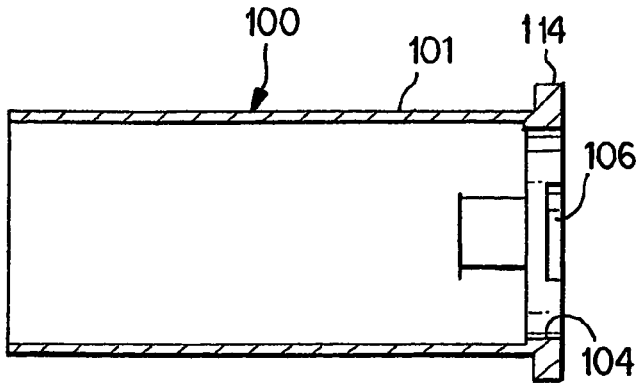
Figure 8C:
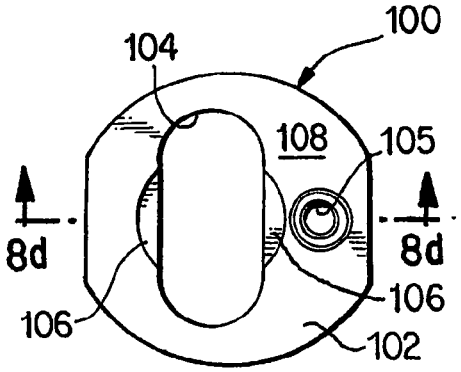
Figure 8D:
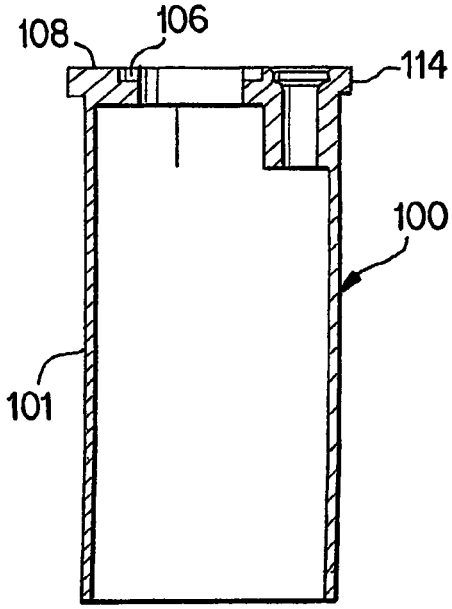

With the second anchor 18 thus firmly attached to the first anchor 10 and the tub surround, the faucet 8 is installed on the outlet tubes 16. As illustrated in FIG. 7, the faucet 8 includes a pair of inlet bores 64 configured to receive the outlet tubes 16. The inlet bores 64 include a pair of sealing o-rings 66 disposed in a pair of grooves 68 to engage the outlet tubes 16. Preferably, the o-rings 66 are disposed near the base of the faucet 8 to sealingly receive the outlet tubes 16 regardless of the height of the decorative surface 56 relative to the outlet tubes 16. Installation is completed by inserting a set screw 59 into a threaded hole 60 in the base of the faucet 8 to engage the set screw-retaining groove 42 in the second anchor 18.

An alternative embodiment of the lower anchor 100, illustrated in FIGS. 8*a*–8*d*, provides a loose fit between the lower anchor 100 and the inlet and outlet tubes 140, 160. The anchor 100 includes a threaded cylindrical sidewall 101 and an end cap 102. The end cap 102 includes a single oval shaped bore 104 for receiving the inlet and outlet tubes 140, 160, and a third bore 105 for receiving the fastener 40. In addition, two semi-circular recesses 106 are formed in the top surface 108 of the end cap 102 for receiving a coupler 110. The end cap 102 extends beyond the threaded sidewall 112 to form a flange 114

The inlet and outlet tubes 140, 160 are rigidly attached to each other by the coupler 110, illustrated in FIGS. 9*a*–9*c*. The coupler 110 includes a body portion 118 and an end plate 120 that extends radially beyond the body portion 118 to form a flange 124. A pair of rounded channels 126 extends longitudinally along opposite sides of the body portion 118 and the end plate 120. The channels 126 are sized to receive the inlet and outlet tubes 140, 160, as illustrated in FIG. 10. The tubes 140, 160 are brazed or soldered to the coupler 110 to form a rigid assembly that is inserted through the single oval bore 104. Preferably, the bore 104 is slightly larger in all directions than the tube/coupler assembly. The remaining portions of the flange 124 not removed by the channels 126 form circular tabs 128 on opposite sides of the tube/coupler assembly. The tabs 128 are operatively disposed in the semi-circular recesses 106.

The plastic tube 54 preferably includes a tube-receiving portion 200 and an anchor-receiving portion 202. The anchor-receiving portion 202 preferably engages the flange 28, 114 and extends upwardly to a flat surface 206. The surface 206 preferably includes indicia marking the surface 206 as the upper limit of the mud and tile forming the decorative surface. The tube-receiving portion 200 forms an oval pocket 208 that extends upwardly from the flat surface 206 and completely surrounds the outlet tubes 160. As seen in FIGS. 12*a*–12*b*, the tube 54 covers the tube assembly and anchor and protects them from the mud and tile.

The above-described embodiments, of course, are not to be construed as limiting the breadth of the present invention. Modifications and other alternative constructions will be apparent which are within the spirit and scope of the invention as defined in the appended claims.

The invention claimed is:

1. Apparatus for installing a single control faucet comprising:

a first anchor configured to engage an upper surface of a roughed-in roman tub installation;

a second anchor configured to receive first and second water conduits and engage a decorative surface applied to the roughed-in roman tub installation and the first anchor;

a cover configured to surround the second anchor and the first and second conduits; and a fastener extending between the first anchor and the second anchor to retain the second anchor in position on the decorative surface.

2. Apparatus for installing a single control roman tub faucet on a deck having a first layer and a second layer disposed on the first layer, the apparatus comprising:

a first anchor including a body and first means extending from the body between the first layer and the second layer and second means coupled to the body and cooperating with the first means to retain the first anchor in position relative to the first layer;

a second anchor including third means disposed above an upper surface of the second layer, fourth means for engaging the first anchor, and fifth means for coupling the second anchor to the roman tub faucet; and a water conduit assembly passing through the first and second anchors.

3. Apparatus for installing a single control roman tub faucet comprising:

a first anchor including first means for engaging an upper surface of a roughed-in installation and means for engaging a lower surface of a roughed-in installation;

a second anchor including second means for engaging an upper surface of a decorative finish applied over the roughed-in installation, third means for engaging the first anchor, and fourth means for engaging the roman tub faucet; and a water conduit assembly passing through the first and second anchors, the water conduit assembly including a hot water conduit, a cold water conduit, and a coupler joining the hot and cold water conduits into a rigid assembly.

4. The apparatus of claim 3 wherein the coupler includes a body portion, an end plate, and a pair of water conduit-receiving channels formed on opposite sides of the body portion and end plate.

5. The apparatus of claim 3 wherein the coupler engages the first anchor to position the rigid assembly in the first anchor.

6. The apparatus of claim 3, further comprising fifth means for covering the hot and cold water conduits and sixth means for indicating a thickness of the decorative finish.

7. A method of installing a faucet comprising:

installing a first anchor, the first anchor including first means for engaging an upper surface of a roughed-in installation and a lower surface of the roughed-in installation; installing a second anchor, the second anchor including second means for engaging an upper surface of a decorative surface applied over the roughed-in installation and third means for engaging the first anchor; and coupling the faucet to the second anchor.

8. The method of claim 7 wherein the first anchor further includes a hot water conduit and a cold water conduit and the second anchor includes fourth means for receiving the hot and cold water conduits.

9. The method of claim 8 wherein the hot and cold water conduits further include fifth means for joining the hot and cold water conduits together to form a rigid assembly.

10. The method of claim 9 wherein the means for joining engages the first anchor to position the assembly in the first anchor.

* * * * *